United States Patent [19]

Schuster

[11] 4,451,979

[45] Jun. 5, 1984

[54] ASSEMBLY AND DISASSEMBLY APPARATUS FOR USE WITH A ROTARY MACHINE

[75] Inventor: Carl J. Schuster, Greensburg, Pa.

[73] Assignee: Elliott Turbomachinery Company, Inc., Jeannette, Pa.

[21] Appl. No.: 200,807

[22] Filed: Oct. 27, 1980

[51] Int. Cl.[3] ..... B23P 19/04

[52] U.S. Cl. ..... 29/824; 29/156.8 R; 29/281.4

[58] Field of Search ..... 29/156.8 R, 426.1, 468, 29/234, 244, 252, 256, 271, 281.1, 281.4, 281.5, 281.6, 778, 770, 700, 823, 824

[56] References Cited

U.S. PATENT DOCUMENTS

| | | | |
|---|---|---|---|
| 1,991,761 | 2/1935 | McHugh . | |
| 2,265,940 | 3/1940 | Forrest . | |
| 2,275,216 | 3/1942 | Broccoli | 29/281.6 |
| 2,566,637 | 9/1951 | Roberts | 29/244 |
| 3,052,140 | 9/1962 | Guyer, Jr. | 29/281.1 |
| 3,064,340 | 12/1957 | Green | 29/240 |
| 3,403,434 | 10/1968 | Calabro | 29/252 |
| 3,432,911 | 3/1969 | Rodgers | 29/281.1 |
| 3,556,742 | 1/1971 | Benzing | 29/256 |
| 3,782,161 | 1/1974 | McGeeney et al. | 29/281.4 |
| 3,810,293 | 5/1974 | Tobak et al. | 29/252 |
| 3,916,499 | 11/1975 | Frame et al. | 29/252 |
| 3,963,231 | 6/1976 | Cooper | 29/281.4 |
| 3,997,962 | 6/1975 | Kleitz et al. | 29/427 |
| 4,044,442 | 8/1977 | Carlson | 29/156.8 R |
| 4,157,613 | 12/1977 | Morrow | 29/732 |

FOREIGN PATENT DOCUMENTS

| | | | |
|---|---|---|---|
| 2026915 | 12/1970 | Fed. Rep. of Germany . | |
| 802529 | 9/1936 | France . | |
| 1305208 | 8/1962 | France | 29/252 |
| 574304 | 9/1977 | U.S.S.R. | 29/234 |

*Primary Examiner*—Daniel C. Crane
*Attorney, Agent, or Firm*—Robert P. Hayter

[57] ABSTRACT

Assembly and disassembly methods and apparatus for a rotary machine. According to a first aspect of the present invention, methods and apparatus are provided for assembling and disassembling a disc end bearing and an intermediate bearing housing of the rotary machine. According to a second aspect of the present invention, methods and apparatus are provided for assembling and disassembling a bearing lifting frame and a removable fluid casing section of the rotary machine. According to a third aspect of the present invention, methods and apparatus are provided for assembling and disassembling an impeller rotor of the rotary machine.

6 Claims, 17 Drawing Figures

ASSEMBLY AND DISASSEMBLY APPARATUS FOR USE WITH A ROTARY MACHINE

BACKGROUND OF THE INVENTION

This invention generally relates to rotary machines, and more specifically to assembling and disassembling rotary machines.

Occasionally, the impeller rotor and blades of a rotary machine such as a centrifugal compressor or expander must be removed from the machine for cleaning, maintenance, or replacement. For example, rotary machines are often used with fluids containing a significant amount of particulates or debris. Over a period of time, these particulates and debris tend to collect or accumulate on the impeller blade surfaces, necessitating periodic removal of the impeller rotor and blades from the machine to clean or replace the blade surfaces. Routine inspection and maintenance, for example to repair or realign a rotor seal or blade, may also require removal of the impeller rotor from the machine.

Typically, in order to remove an impeller rotor from a rotary machine, a large portion of the machine must be disassembled. Many of the parts which must be disassembled are large, heavy, and thus difficult to maneuver. Moreover, when reassembled, usually these parts must be accurately aligned relative to each other and to any equipment used with the rotary machine such as an electric motor or generator. As a result, disassembly and reassembly of a rotary machine requires skilled labor. Further, of course, the machine is inoperable and, hence, unproductive while being assembled and disassembled.

SUMMARY OF THE INVENTION

In view of the above, an object of the present invention is to facilitate and expedite assembly and disassembly of a rotary machine, specifically the removal and replacement of an impeller rotor thereof.

Another object of this invention is to simplify and assist realigning various parts of a rotary machine which are removed therefrom in order to remove the impeller rotor of the machine.

A further object of the present invention is to disassemble the rotor bearings of a rotary machine without disassembling a frame or fluid casing of the machine.

Still another object of the present invention is to move an intermediate bearing housing and a disc end bearing of a rotary machine away from and toward assembled positions while maintaining axial orientation of the intermediate bearing housing and the disc end bearing.

Another object of this invention is to move a removable casing section of a rotary machine toward and away from an assembled position while maintaining axial orientation of the removable casing section.

A further object of the present invention is to axially move an impeller rotor into and out of a rotary machine without moving the frame of the machine.

Another object of the present invention is to extend rail means through a fluid casing of a rotary machine to guide movement of an impeller rotor into and out of the fluid casing.

According to a first aspect of the present invention, methods and apparatus are provided for assembling and disassembling a disc end bearing and an intermediate bearing housing of a rotary machine. This assembly and disassembly apparatus includes rail means supported by a frame of the rotary machine and extending into a fluid casing thereof, and transport means movably supported by the rail means for moving the disc end bearing and the intermediate bearing housing along the rail means. The assembly and disassembly apparatus further includes lifting means supported by the machine frame and extending within the fluid casing for moving the disc end bearing between a bearing assembled position and the transport means and for moving the intermediate bearing housing between a housing assembled position and the transport means.

According to a second aspect of the present invention, methods and apparatus are provided for assembling and disassembling a rotor seal, a bearing lifting frame, and a removable casing section of a rotary machine. The assembly and disassembly apparatus comprises means for moving the rotor seal away from a seal assembled position, means supporting the lifting frame for movement along a machine frame of the rotary machine, and means for moving the lifting frame rearward along the machine frame into a disassembled position. This assembly and disassembly apparatus further comprises means for moving the removable casing section between an assembled position and a lifted position, a pulling fixture supporting the removable casing section for movement along the machine frame, and means for moving the pulling fixture along the machine frame to move the removable casing section between the lifted position and a disassembled position.

According to a third aspect of the present invention methods and apparatus are provided for assembling and disassembling an impeller rotor of a rotary machine. The rotor assembly and disassembly apparatus comprises a rotor stand located adjacent to the rotary machine for supporting the impeller rotor in a disassembled position, and rail means supported by the machine frame and the rotor stand and extending therebetween through a fluid casing of the rotary machine for guiding movement of the impeller rotor through the fluid casing between the machine frame and the rotor stand. The rotor assembly and disassembly apparatus further comprises cradle means supporting the impeller rotor for movement along the rail means, and lifting means for moving the impeller rotor between an assembled position and the cradle means.

A DETAILED DESCRIPTION OF THE PREFERRED EMBODIMENT

Figure 1:
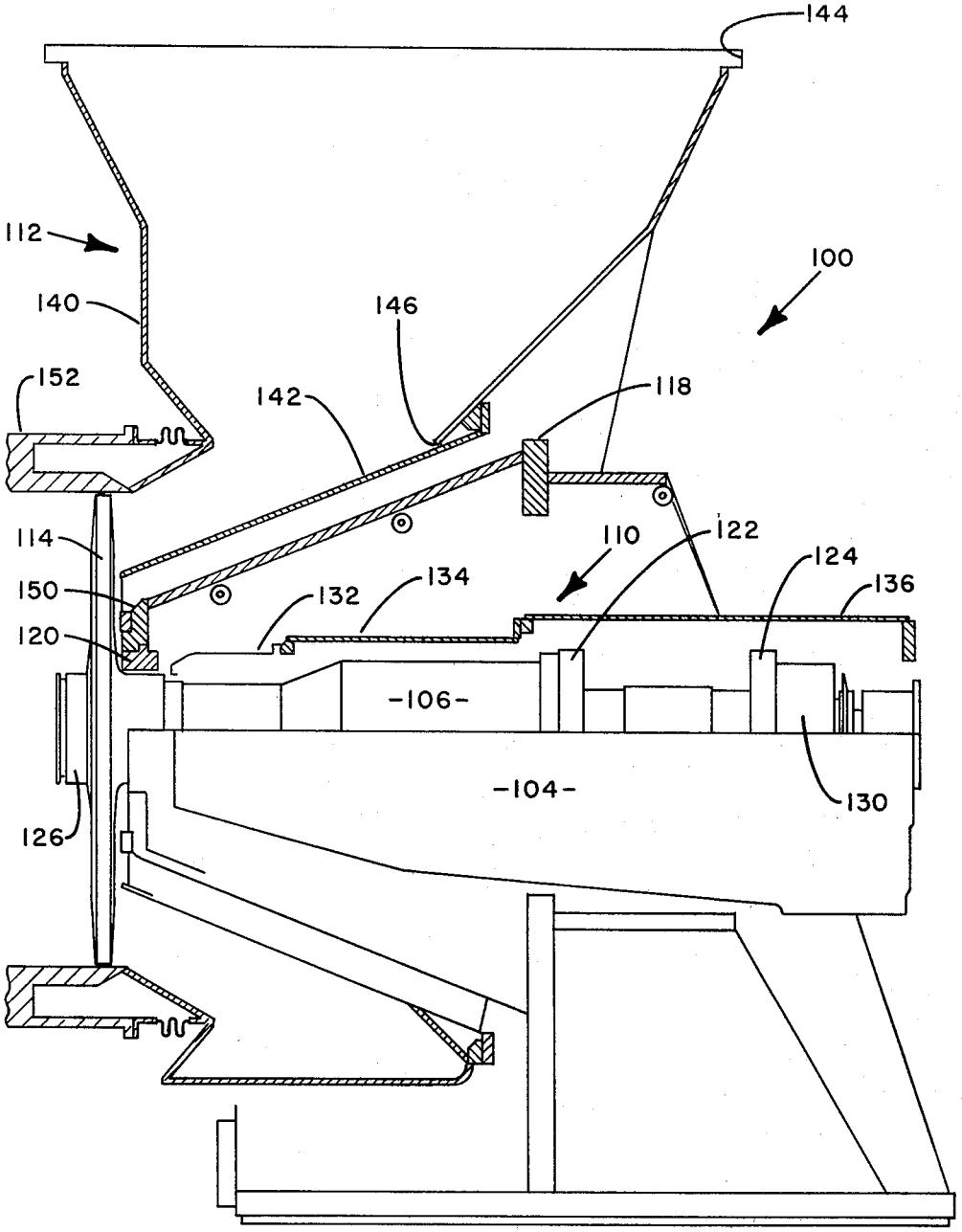
FIG. 1 is a side view partially in cross section of a rotary machine with which the present invention may be employed.
Figure 2:
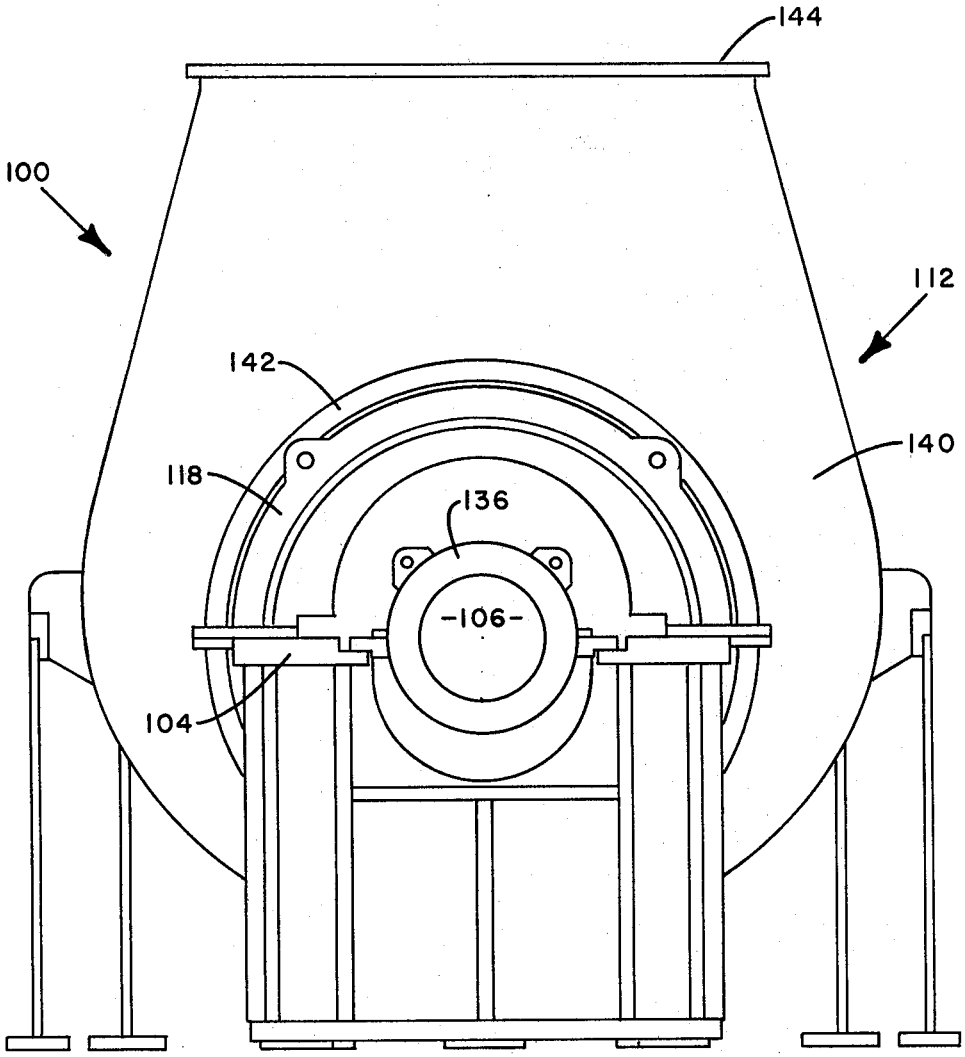
FIG. 2 is a rear view of the machine illustrated in FIG. 1.

Particularly referring to FIGS. 1 and 2, there is illustrated rotary machine 100 with which the present invention may be employed. Generally, machine 100 includes machine frame 104, impeller rotor 106, bearing means 110, and fluid casing 112. Machine 100 also includes impeller blade 114, bearing lifting frame 118, and rotor seal 120. Impeller rotor 106, having radial flanges 122 and 124, disc end 126, and coupling end 130, axially extends along the top of machine frame 104 and is rotatably supported by bearing means 110 which, in turn, are supported by the machine frame. Preferably, bearing means 110 are of a conventional horizontal split type including disc end bearing 132, intermediate bearing housing 134, and coupling end bearing 136, which preferably are all bolted to the top of machine frame 104. Impeller blade 114 is rigidly secured to disc end 126 of rotor 106 and radially extends outward therefrom. Although one impeller blade 114 is shown in the drawings, it will be apparent to those skilled in the art that the present invention may be employed with a rotary machine having one or more axially spaced sets of impeller blades.

Fluid casing 112 includes main, stationary section 140 and removable, semi-annular section 142. Stationary section 140 is secured to machine frame 104 and annularly extends around the machine frame and impeller rotor 106 rearward, to the right as viewed in FIG. 1, of impeller blade 114. The top of stationary section 140 defines fluid discharge or outlet opening 144 and the back of section 140 defines semi-annular casing opening 146.

Removable casing section 142 is positioned on and disengagably secured, preferably by bolts, to machine frame 104, and casing section 142 annularly extends across the machine frame above rotor 104. In the axial direction, casing section 142 extends generally between impeller blade 114 and the surfaces of casing section 140 which define casing opening 146 to conduct fluid between the impeller blade and the stationary casing section. It should be noted, however, that, for reasons discussed in detail below, removable casing section 142 is radially slightly spaced from adjacent surfaces of stationary casing section 140, allowing slight vertical movement of the removable casing section.

Bearing lifting frame 118, discussed in greater detail below, axially extends within fluid casing 112 below removable casing section 142 and annularly extends above rotor 106 and bearing means 110. Lifting frame 118 is positioned on machine frame 104 and removably secured thereto by any suitable means such as bolts, and the forward end of the lifting frame defines radial flange 150. Rotor seal 120 annularly extends over rotor 106 to retard fluid flow therealong. With the embodiment illustrated in the drawings, rotor seal 120 is secured, preferably bolted, to lifting frame 118, specifically flange 150 thereof, and covers the space between the forward end of the lifting frame, machine frame 104, and rotor 106 to prevent leakage of a working fluid through this space. Rotor seal 120 defines a plurality of axially extending threaded apertures, and some of these apertures are aligned with axially extending threaded apertures defined by radial flange 150 of bearing lifting frame 118 for bolting the rotor seal thereto. Preferably, however, for reasons which will become apparent, some of the axial, threaded apertures defined by rotor seal 120 are located adjacent flat surfaces of radial flange 150.

To operate machine 100, inlet duct 152 is secured to the forward end of fluid casing 112, annularly extending around impeller blade 114. Preferably, support means such as a duct stand (not shown) is secured to inlet duct 152 to support the duct. Once duct 152 is in position, a fluid is induced to flow through the inlet duct and past blade 114. If machine 100 is a compressor, then rotor blade 114 is rotated to compress the fluid flowing therepast. Alternately, if machine 100 is an expander, then the fluid causes rotation of blade 114. In either case, the fluid flows past blade 114 and through fluid casing 112, and the fluid is discharged from machine 100 via discharge opening 144.

As previously discussed, the impeller rotor of rotary machines of the general type described above are occasionally removed therefrom, and this often requires disassembling a large portion of the machine. In accordance with teachings of the present invention, machine 100 may be assembled and disassembled comparatively fast using methods and apparatus which are relatively inexpensive and simple to understand and operate. FIGS. 3 through 17 illustrate methods and apparatus for assembling and disassembling machine 100 in accordance with a preferred embodiment of the present invention. More specifically, FIGS. 3 through 6 illustrate apparatus for removing disc end bearing 132 and intermediate bearing housing 134; FIGS. 7 through 11 show apparatus for removing rotor seal 120, bearing lifting frame 118, and removable casing section 142; and FIGS. 13 through 17 illustrate apparatus for assembling and disassembling impeller rotor 106.

Preferably, before machine 100 is disassembled, inlet duct 152 and any support stand therefor are removed. After duct 152 is disengaged from fluid casing 112, the duct and any duct stand may be conventionally removed by means of an overhead crane, and it is felt that a thorough discussion of the removal process is not herein needed. With duct 152 removed away from rotary machine 100, undivided attention may be directed to the disassembly of the rotary machine itself.

Disc End Bearing And Intermediate Bearing Housing Assembly And Disassembly Apparatus Turning first to FIGS. 3 through 6, there is shown apparatus 200 for assembling and disassembling intermediate bearing housing 134 and disc end bearing 132. Preferably, apparatus 200 includes lifting frame 118, pulleys 202, 204, and 206, cables 210, and hooks 212 (only one cable and hook are shown in the drawings). Apparatus 200 further includes power means such as winch 214, guide rails 216, and transfer car 220. Transfer car 220, in turn, includes feet 222, wheels 224, housing support platform 226, and bearing support arms 230. Transfer car 220 also includes rocker arms 232, connecting rods 234, and turnbuckle 236.

Figure 3:
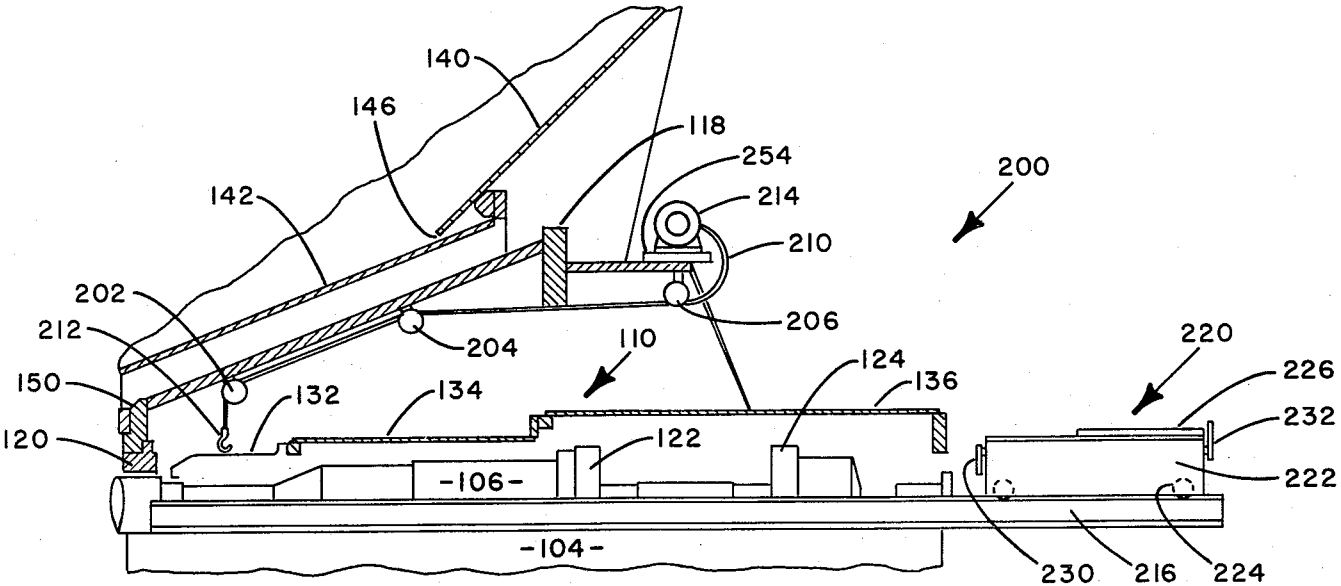
FIG. 3 is an enlarged partial side view of the rotary machine shown in FIG. 1 and of apparatus for assembling and disassembling a disc end bearing and an intermediate bearing housing of the rotary machine.
Figure 4:
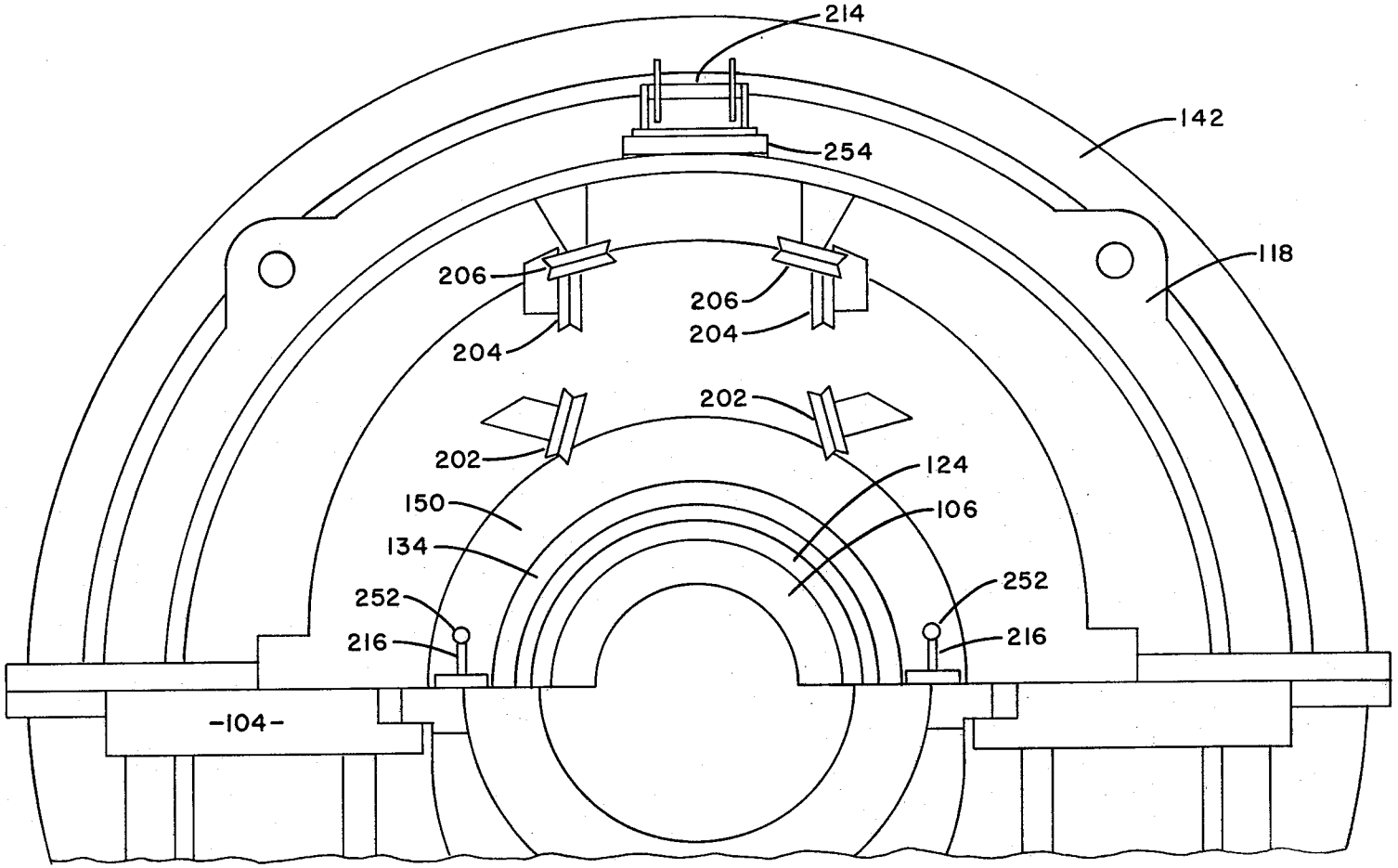
FIG. 4 is a rear view illustrating parts of the rotary machine and assembly and disassembly apparatus illustrated in FIG. 3.

Particularly referring to FIGS. 3 and 4, lifting frame 118, as previously mentioned, axially extends within fluid casing 112, annularly extends above rotor 106 and bearing means 110, and is positioned on and bolted to machine frame 104. Preferably, it should be noted, bearing lifting frame 118 is secured in place when machine 100 is originally assembled, before disc end bearing 132, intermediate bearing housing 134, and coupling end bearing 136 are initially positioned within the rotary machine. Pulleys 202, 204, and 206 are rotatably connected to lifting frame 118. More specifically, pulleys 202 are located above disc end bearing 132, pulleys 204 are located above intermediate bearing housing 134, and pulleys 206 are located at the rearward end of bearing lifting frame 118.

Figure 5:
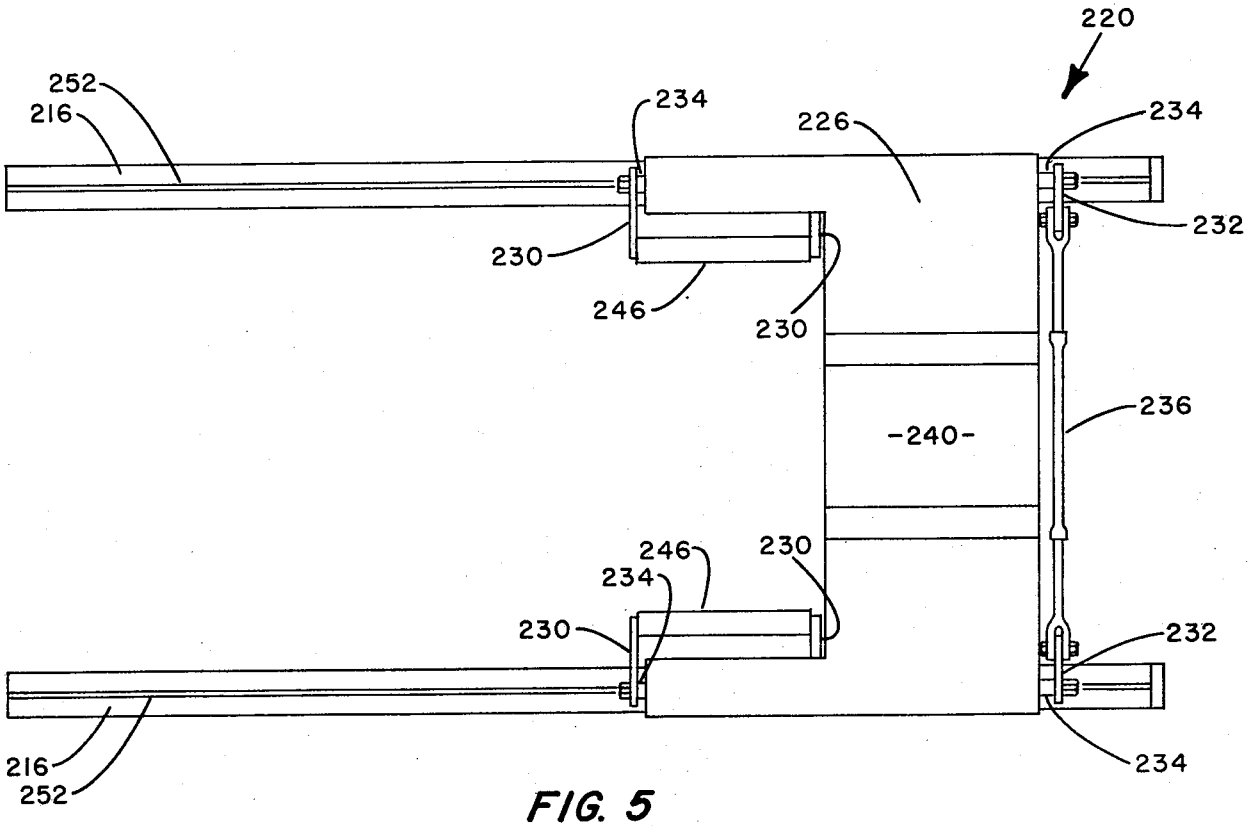
FIGS. 5 and 6 are top and front views respectively showing a pair of rails and a transfer car of the assembly and disassembly apparatus shown in FIG. 3.
Figure 6:
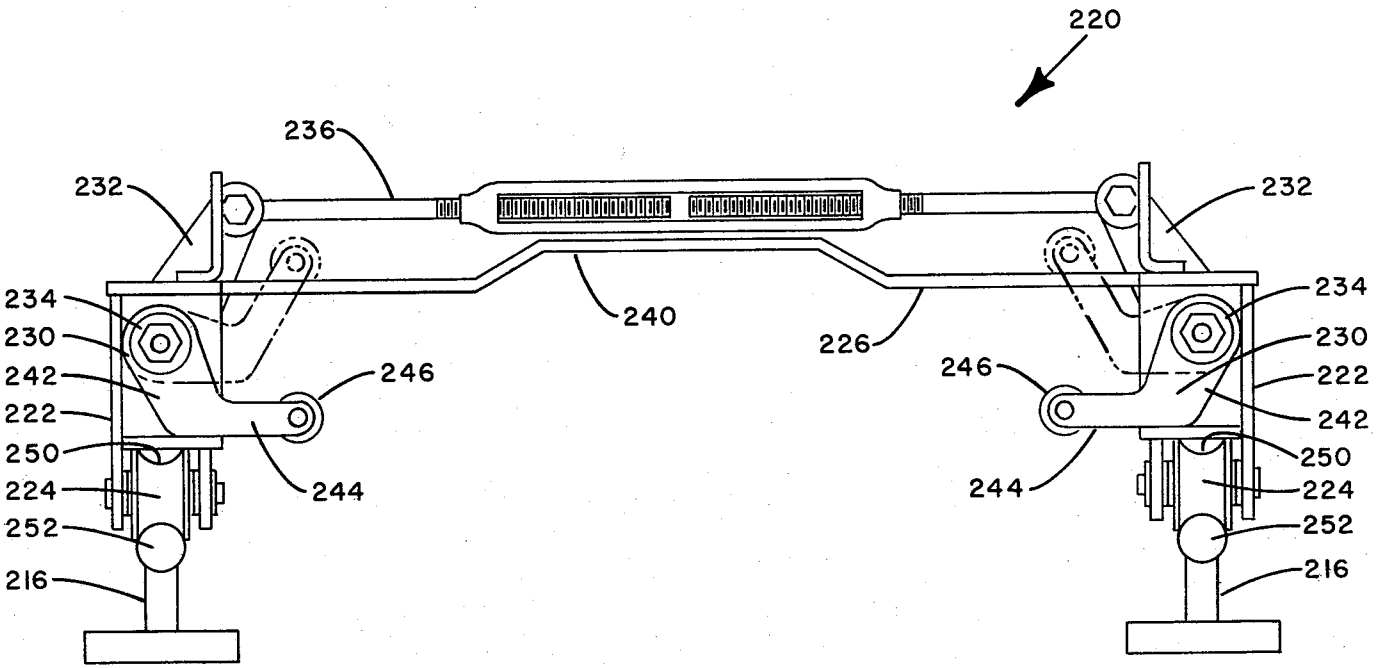

Now particularly referring to FIGS. 5 and 6, feet 222 of transfer car 220 are supported by wheels 224, which are rotatably connected to the feet in any conventional manner. Housing support platform 226 horizontally extends between and is secured to the top of feet 222, and preferably the housing support platform includes raised central portion 240. Connecting rods 234 extend through and are rotatably supported by feet 222. Forward of housing support platform 226, a pair of bearing support arms 230 are secured to each connecting rod for rotation therewith. Preferably, bearing support arms 230 are angularly shaped having upper arm portions 242, which extend downward and inward from connecting rods 234, and forearm portions 244, which extend inward from the upper arm portions at an obtuse angle thereto. Support rollers 246 are rotatably supported by and axially extend between forearm portions 244 of adjacent arms 230. Rearward of housing support platform 226, a rocker arm 232 is secured to each connecting rod 234 for rotation therewith. Rocker arms 232 generally extend inward and upward from connecting rods 234, and turnbuckle 236 is secured to and extends between portions of the rocker arms above the connecting rods.

With the above-described arrangement, turnbuckle 236, connecting rods 234, rocker arms 232, and bearing support arms 230 may be employed, for reasons which will become apparent, to vary the height of support rollers 246 between lowered and raised positions shown, respectively, in full and broken lines in FIG. 6. More particularly, extension and retraction of turnbuckle 236 pivot each rocker arm 232 outward and inward respectively about the centerline of the connecting rod 234 to which the rocker arm is secured. Since rocker arms 232 and bearing support arms 230 are secured to connecting rods 234 for rotation therewith, the above-mentioned pivotal movement of the rocker arms is transmitted to the bearing support arms via the connecting rods. With reference to FIG. 6, outward and inward pivotal movement of rocker arms 232 swing forearm portions 244 of each support arm 230 upward and downward respectively, raising and lowering bearing support rollers 246. Thus, to summarize, extension and retraction of turnbuckle 236 respectively raises and lowers forearm portions 244 of arms 230 and support rollers 246.

Bearing Disassembly

The first step in the disassembly of bearing means 110 is the removal of coupling end bearing 136. Bearing element 136 is easily removable in any conventional manner, for example by means of a crane and cable which are maneuvered into the space above the coupling end bearing, and it is believed that a detailed illustration and explanation of the removal thereof is not necessary.

To remove disc end bearing 132 and intermediate bearing housing 134, rails 216 are positioned on machine frame 104 and secured thereto. Preferably, rails 216 are located parallel to the axis of rotor 106 and axially extend into fluid casing 112 and bearing lifting frame 118. Transfer car 220, specifically wheels 224 thereof, is positioned on rails 216. Preferably, wheels 224 define annular recesses 250 which cooperate with rounded, top surfaces 252 of rails 216 to guide movement of transfer car 220 therealong. Winch 214 is secured to lifting frame 118, specifically platform 254 thereof. First ends of cables 210 are secured to winch 214 and hooks 204 are connected to second ends of the cables.

The hook ends of cables 210 are guided underneath pulleys 206 and over pulleys 204, and hooks 212 are connected to intermediate bearing housing 134. Winch 214 is then employed to raise intermediate bearing housing 134 to a lifted position wherein transfer car 220 may be moved thereunder. When intermediate bearing housing 134 has been raised to the lifted position, transfer car 220, with rollers 246 in their raised position, is moved along rail 216 until housing support platform 226 of the transfer car is directly below the intermediate bearing housing. Housing 134 is then lowered onto support platform 226, and hooks 212 are disconnected from the intermediate bearing housing. Transfer car 220 is then moved rearward along rails 216, carrying housing 134 out of fluid casing 112 and into a disassembled position where the intermediate bearing housing is easily accessible to a laborer or to other material handling equipment. Housing 134 may then be moved to a remote location by means such as an overhead crane.

After intermediate bearing housing 134 is removed, hook ends of cables 210 are guided around front pulleys 202 and hooks 212 are connected to disc end bearing 132. Winch 214 is employed to raise disc end bearing 132 to a lifted position wherein support rollers 246 of transfer car 220, when in their lowered position, may be moved under the disc end bearing. Transfer car 220, with support rollers 246 still in their raised position, is moved forward along guide rails 216 until rollers 246 are forward of rotor flange 122. Turnbuckle 236 is then retracted, pivoting rollers 246 downward into their lowered position. With disc end bearing 132 in its lifted position and support rollers 246 in their lowered position, transfer car 220 is further moved along rails 216 to a position where the bearing support rollers are directly below the disc end bearing. Bearing 132 is then lowered onto rollers 246, and hooks 212 are disconnected from the disc end bearing. Transfer car 220 is moved rearward along rails 216 until reaching the vicinity of rotor flange 122. Turnbuckle 236 is extended, pivoting bearing support arms 230 upward and raising rollers 246 into their raised position wherein the rollers and disc end bearing 132 will clear rotor flanges 122 and 124. Transfer car 220 is then further moved rearward, past flanges 122 and 124 and out of fluid casing 112, carrying disc end bearing 132 into a disassembled position where the disc end bearing is readily accessible to a laborer or to other bearing handling equipment such as a crane. Disc end bearing 132 may then be easily transported to a location remote from rotary machine 100.

Thus, intermediate bearing housing 134 and disc end bearing 132 are quickly and easily removed from machine 100. Furthermore, with the preferred embodiment, the axial orientation of disc end bearing 132 and intermediate bearing housing 134 are maintained as the disc end bearing and intermediate bearing housing move between their assembled and disassembled positions. More specifically, as disc end bearing 132 moves between its assembled and disassembled positions, the longitudinal axis thereof, that is, the axis of the disc end bearing which is parallel to the axis of impeller rotor 106 when both the impeller rotor and the disc end bearing are assembled in machine 100, is maintained substantially parallel to or colinear with the longitudinal axis of the disc end bearing as assembled. Similarly, as intermediate bearing housing 134 moves between its assembled and disassembled positions, the longitudinal axis thereof, that is, the axis thereof which is parallel to the axis of impeller rotor 106 when both the impeller rotor and the intermediate bearing housing are assembled, is maintained substantially parallel to the longitudinal axis of the intermediate bearing housing as assembled.

Apparatus For Assembling And Disassembling The Rotor Seal, The Bearing Lifting Frame, And The Removable Casing Section With bearing elements 132, 134, and 136 removed, the next step in the disassembly of machine 100 is the removal of rotor seal 120, bearing lifting frame 118, and removable casing section 142. Specifically referring to FIGS. 7 through 11, there is illustrated apparatus for assembling and disassembling rotor seal 120, bearing lifting frame 118, and removable casing section 142 in accordance with a preferred embodiment of the present invention.

Generally, this apparatus includes hydraulic jacks 302, rollers 304, and first, second, and third sets of threaded pull rods 306, 310, and 312. The seal, frame, and casing removing apparatus further includes semiannular rib portion 314 of bearing lifting frame 118, pulling plates 316, T-brackets 320, and pulling fixture 322. Preferably, annular end portions of rib 314 define axially extending apertures 324 and horizontally extending shoulder surfaces 326 spaced from machine frame 104, pulling plates 316 define axially extending apertures 330 and 332, and T-brackets 320 are secured, for example welded, to a radially inside surface of removable casing section 142 and extend downward therefrom.

Figure 10:
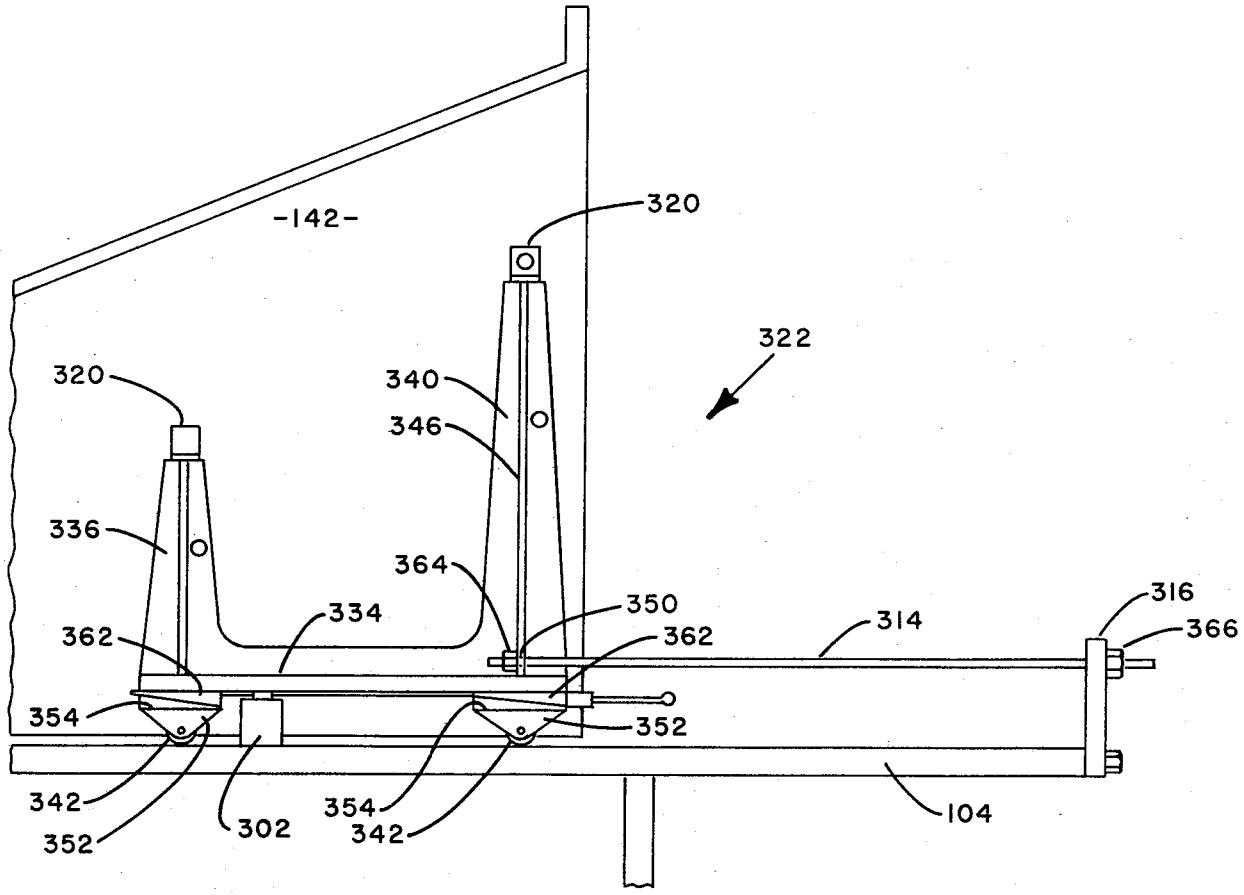
FIGS. 10 and 11 are partial side and rear views respectively of the machine frame and removable casing section of the rotary machine shown in FIG. 1 and of apparatus for assembling and disassembling the removable casing section.
Figure 11:
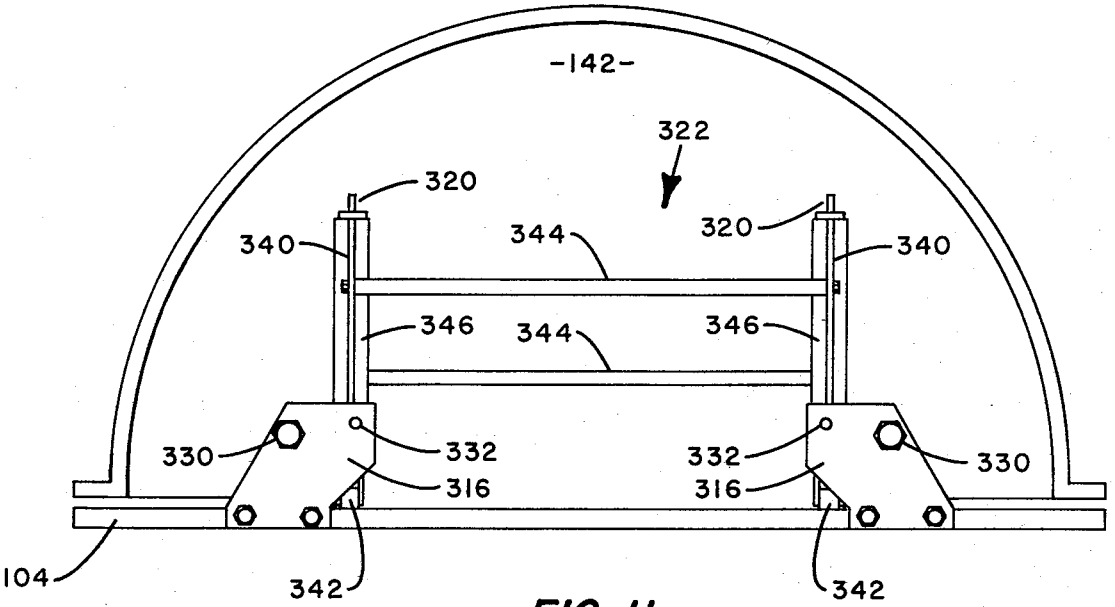
Figure 12:
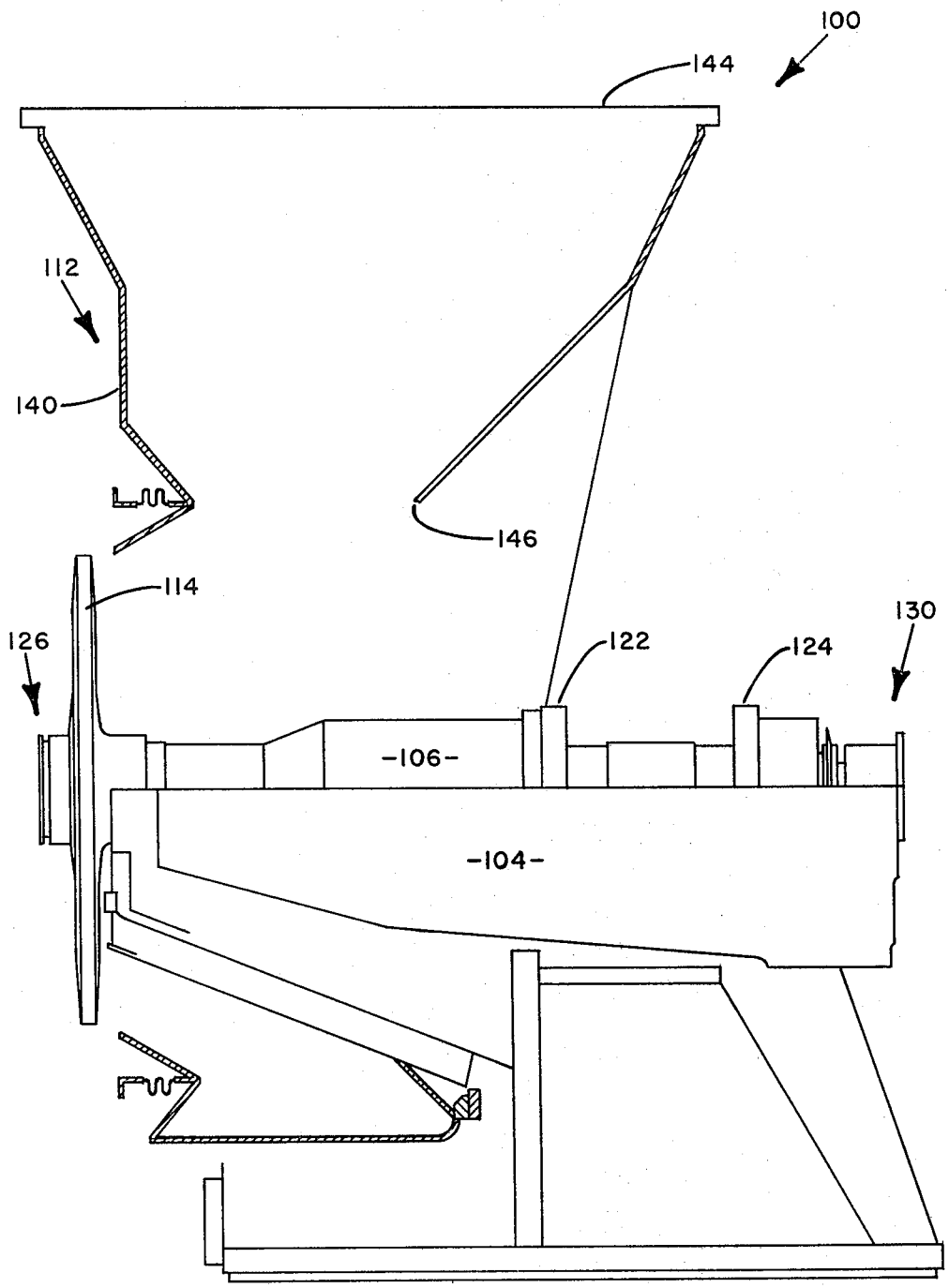
FIG. 12 is a side view similar to FIG. 1 but with the rotary machine in a partially disassembled position.

Particularly referring to FIGS. 10 and 11, pulling fixture 322 includes spaced, parallel feet 334, front legs 336, rear legs 340, wheels 342, and connecting braces 344. Legs 336 and 340 are secured to and extend upward from feet 334. Rear legs 340 are located rearward of front legs 336, and the rear legs include vertical flange portions 346, which define axially extending apertures 350. Braces 340 are connected to and transversely extend between legs 336 and 340 to support the legs and to maintain a preset distance therebetween. Legs 336 and 340 are designed to simultaneously, abuttingly engage T-brackets 320 as the legs and feet 334 are raised. Thus, front legs 336 are shorter than rear legs 340, with the specific relative height of the legs depending on the specific relative location of T-brackets 320.

Wheels 342 support feet 334 and are connected thereto in any suitable manner which produces substantially unitary axial movement between the wheels and the feet while allowing relative vertical movement therebetween. For example, feet 334 may define horizontally extending slots, and wheels 342 may be rotatably connected to brackets 352 which vertically extend through these slots of the feet. Brackets 352 include horizontally extending shoulder surfaces 354 disposed directly below solid surfaces of feet 334 to limit downward movement of the feet relative to brackets 352 and wheels 342.

Figure 7:
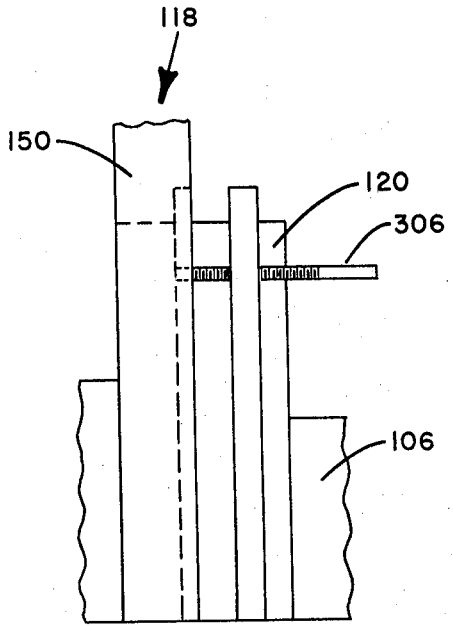
FIG. 7 is a side view showing a rotor seal of the rotary machine illustrated in FIG. 1 and apparatus for disassembling the seal from the rotary machine.

Disassembly of the Rotor Seal, The Bearing Lifting Frame, And The Removable Casing Section Referring to FIG. 7, to remove rotor seal 120, the seal is first unbolted from bearing lifting frame 118, specifically radial flange 150 thereof. As previously mentioned, rotor seal 120 defines a plurality of axially extending apertures some of which are located adjacent to flat surfaces of radial flange 150. Once seal 120 is unbolted from bearing lifting frame 118, threaded pull rods 306 are threaded through axially extending apertures defined by the rotor seal and into abutting contact with flange 150 of the bearing lifting frame. Further rotation of pull rods 306, as is well known to those skilled in the art, pulls rotor seal 120 along the pull rods away from flange 150 of bearing lifting frame 118. When rotor seal 120 is axially spaced from flange 150, the rotor seal may be manually carried out of fluid casing 112. Alternately, transfer car 220, in a manner very similar to that described above which reference to the removal of disc end bearing 132, may be employed to carry rotor seal 120 out of fluid casing 112. Once out of fluid casing 112, rotor seal 120 is transported away from machine 100, either manually or by conventional material handling apparatus.

Figure 8:
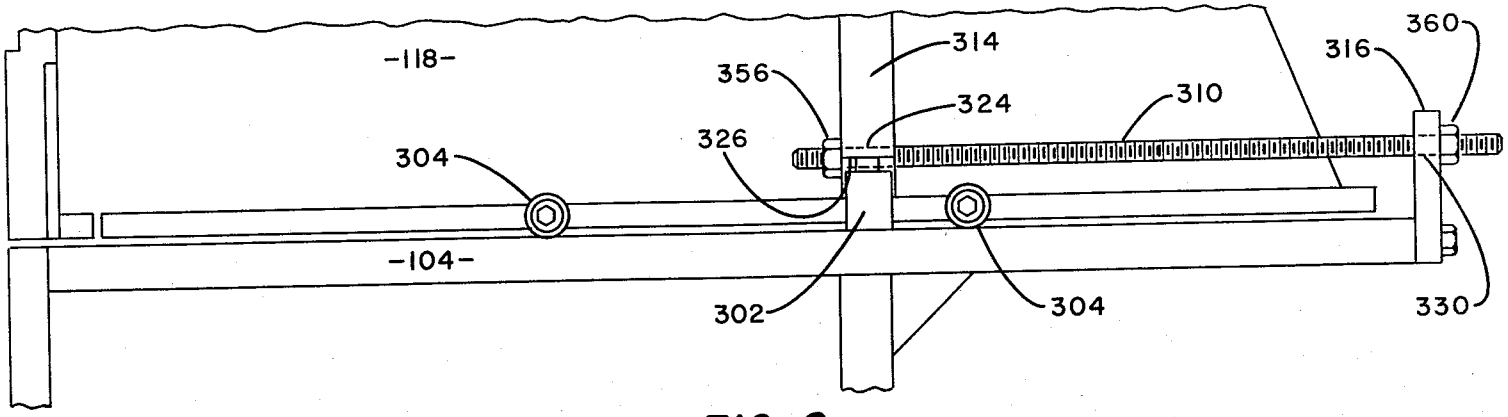
FIGS. 8 and 9 are partial side and rear views respectively of the machine frame of the rotary machine shown in FIG. 1, a bearing lifting frame, and apparatus for assembling and disassembling the bearing lifting frame.
Figure 9:
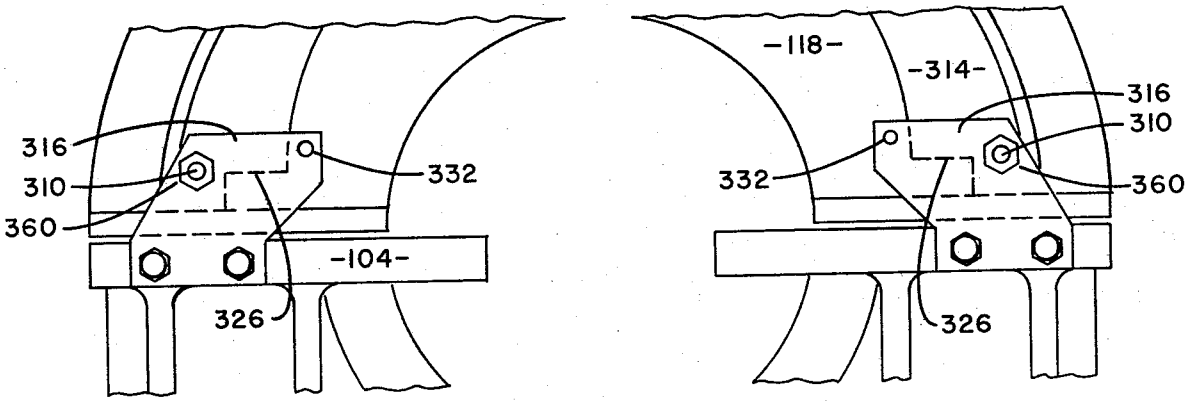

Turning now to FIGS. 8 and 9, to remove bearing lifting frame 118, pulling plates 316 are secured to the rear end of machine frame 104, with apertures 330 and 332 located at a height above the top of the machine frame. Hydraulic jacks 302 are positioned on machine frame 104 underneath shoulders 326 of rib 314 of lifting frame 118. Jacks 302 are extended, raising lifting frame 118 off machine frame 104. Rollers 304 are rotatably secured to axially extending terminal edges of lifting frame 118, and then hydraulic jacks 302 are retracted, lowering rollers 304 onto machine frame 104. Hydraulic jacks 302 are then removed. Rollers 304 are designed so that when the rollers support bearing lifting frame 118, apertures 324 of rib 314 are aligned with apertures 330 of pulling plates 316. Threaded pull rods 310 are inserted through holes 324 and 330. When this is done, nuts 356 are threaded over the ends of pull rods 310 forward of rib 314. Then, pull rods 310 are pulled rearwardly through pulling plates 316, pulling lifting frame 118 rearward away from fluid casing 112. Preferably, nuts 360 are threaded over the rear ends of pull rods 310 and brought forward into abutting contact with pulling plates 316, and the pull rods are pulled rearwardly by rotating nuts 360 about the pull rods and against the pulling plates. Bearing lifting frame 118 is moved rearwardly as described above into a disassembled position, preferably wherein rib 314 is rearward of fluid casing 112. Forward nuts 356 are removed from pull rods 310, and the pull rods are pulled rearwardly through holes 324 and 330 and removed from machine 100. Preferably, hooks (not shown) are connected to the outside surface of lifting frame 118, and the bearing lifting frame is transported away from machine 100 to a remote location by means of an overhead crane.

After lifting frame 118 is removed, the next step in the disassembly of machine 100 is to remove removable casing section 142. Referring to FIGS. 10 and 11, to remove casing section 142, pulling fixture 322 is positioned on machine frame 104 with legs 336 and 340 directly below T-brackets 320. Hydraulic jacks 302 are positioned on machine frame 104 beneath feet 334 of fixture 322, and the jacks are extended to raise the feet and legs 336 and 340. Legs 336 and 340 are raised into abutting contact with T-brackets 320, and further extension of the hydraulic jacks raises removable casing section 142 off machine frame 104. Hydraulic jacks 302 are extended until apertures 350, defined by flanges 346 of rear legs 340, are aligned with apertures 332 defined by pulling plates 316.

When these apertures are aligned, V-shaped wedges 362 are tightly forced between feet 334 and shoulders 354 of wheel brackets 352, wherein wheels 342, brackets 352, and wedges 362 support feet 334, legs 336 and 340, and casing section 142 independent of hydraulic jacks 302. Jacks 302 are then retracted and removed. Next, threaded pull rods 312 are employed to pull pulling fixture 322 and, thus, removable casing section 142 axially rearward. More particularly, pull rods 314 are inserted through aligned apertures 332 and 350. Forward nuts 364 are threaded over the forward ends of pull rods 312, forward of leg flanges 346. Rear nuts 366 are threaded over the rear ends of pull rods 312 and brought into abutting contact with pulling plates 316. Further rotation of rear nuts 366 pulls rods 312 rearwardly through pulling plates 316.

Of course, as pull rods 312 are pulled rearwardly, pulling fixture 322 and removable casing section 142 are pulled rearwardly with the pull rods. Pull rods 312 and removable casing section 142 are pulled rearwardly until the removable casing section reaches a disassembled position, wherein casing section 142 is easily accessible to a laborer. Then, removable casing section 142 is lifted off legs 336 and 340 and carried away from machine 100 either manually or by conventional material moving equipment. Forward nuts 364 are removed, and pull rods 312, with rear nuts 366 mounted thereon, are pulled through apertures 332 and 350 and removed from rotary machine 100. Pulling fixture 322 is then manually lifted off machine frame 104 and carried away from machine 100. Machine 100 is now in the partially disassembled position shown in FIG. 12.

Thus, rotor seal 120, bearing lifting frame 118, and removable casing section 142 are removed from machine 100 in a relatively quick and simple manner. Furthermore, with the preferred embodiment illustrated in the drawings, axial orientation of bearing lifting frame 118 and removable casing section 142 are maintained as the lifting frame and casing section move between their assembled and disassembled positions. More specifically, as bearing lifting frame 118 moves between its assembled and disassembled positions, the longitudinal axis thereof is maintained substantially parallel to its longitudinal axis as assembled. Similarly, as removable casing section 142 moves between its assembled and disassembled positions, the longitudinal axis thereof is maintained substantially parallel to the longitudinal axis of fluid casing section 142 as assembled.

Rotor Assembly And Disassembly Apparatus

Machine 100 is now prepared for the removal of impeller rotor 106. Turning to FIGS. 13 through 17, there is shown rotor assembly and disassembly apparatus 400. Apparatus 400 includes, generally, rotor stand 402, guide rails 404, disc end fixture 406, and coupling end fixture 410. Apparatus 400 further includes disc end cradle 412, coupling end cradle 414, and means such as cables 416 for connecting cradles 412 and 414. Rotor stand 402 preferably includes a pair of spaced, parallel, longitudinally extending top beams 420, and a plurality of legs 422, feet 424, cross beams 426, angle beams 430, and braces 432 for rigidly supporting top beams 420. A pair of support brackets 434 laterally extend outward from top beams 420 for supporting disc end fixture 406, as explained below.

With particular reference to FIGS. 13 through 16, disc end fixture 406 and coupling end fixture 410 are substantially identical, including frames 436, power means such as hydraulic cylinders 440, and rotor carrying means preferably comprising yokes 442 and cables or slings 444. Frames 436, in turn, include feet 446, spaced, parallel legs 450, top, slightly spaced apart cross members 452, and braces 454. Legs 450 extend upward from feet 446, and spaced cross members 452 are secured to and transversely extend between top portions of legs 450. Braces 454 extend between legs 450 and cross members 452 to further support the cross members. Hydraulic cylinders 440 are secured to frames 436, specifically top cross members 452 thereof. The head ends of cylinders 440 extend upward from cross members 452, and the rod ends of the cylinders extend downward through the space between the cross members. Yokes 442 are secured to the rod ends of cylinders 440, below cross members 452, and the ends of cable 444 are connected to opposite transverse ends of the yokes.

Figure 15:
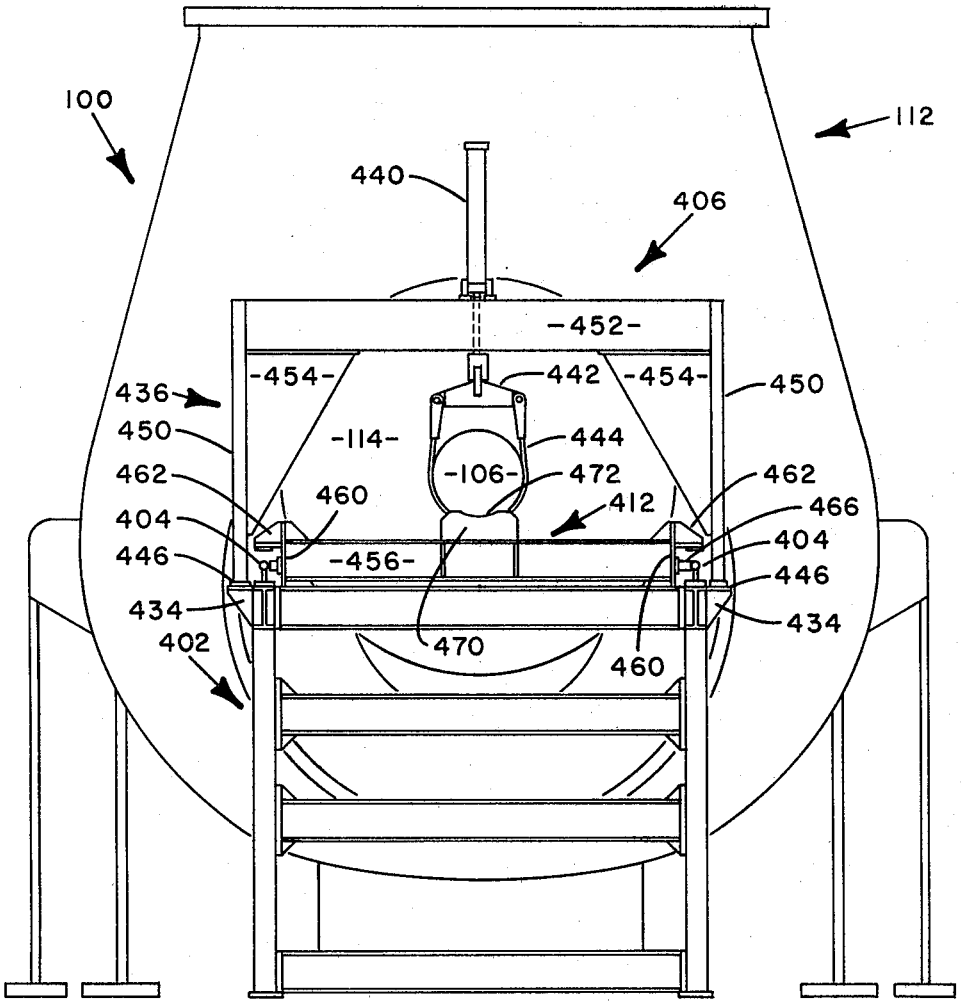
Figure 16:
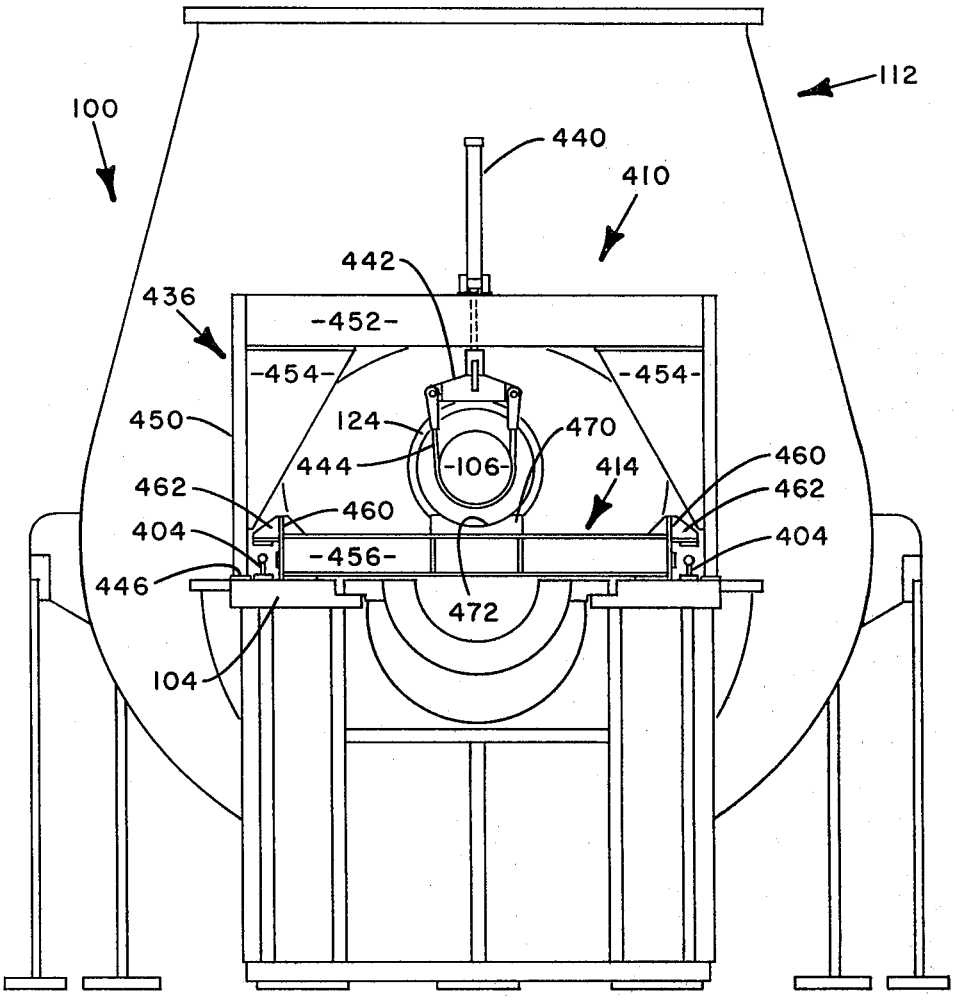
Figure 17:
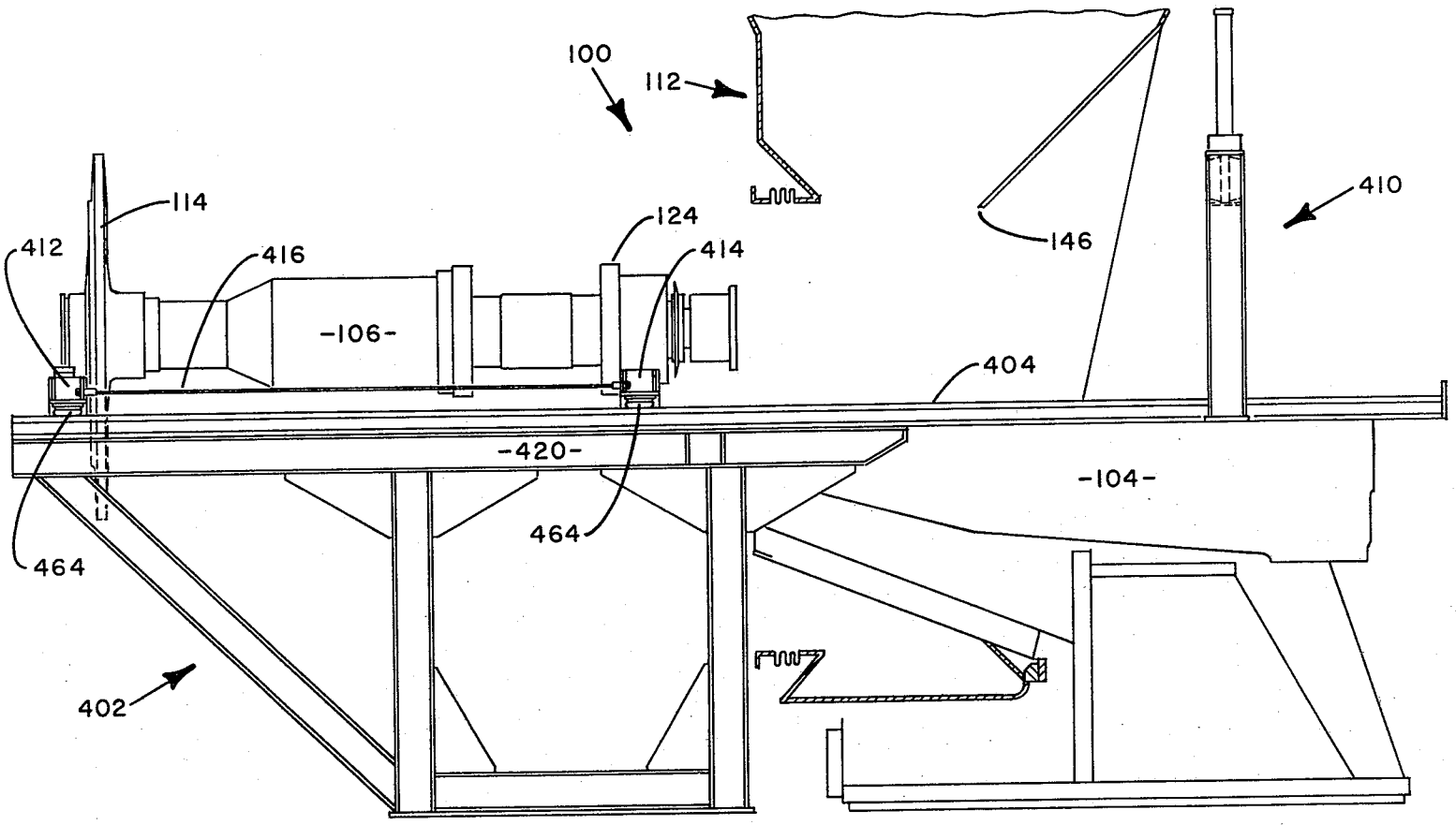
FIG. 17 is a side view similar to FIG. 13 but with the impeller rotor shown in a disassembled position.

Discussing the preferred design of disc and coupling end cradles 412 and 414 in greater detail, now with particular reference to FIGS. 15 through 17, the cradles are very similar, including cross beams 456, end plates 460, brackets 462, support bearings 464, guide bearings 466, and rotor pedestal 470. End plates 460 are secured to longitudinal ends of cross beams 456 and extend upward therefrom. Brackets 462 are secured to and extend outward from top portions of end plates 460. Support bearings 464 (shown only in FIG. 17), preferably of the roundway, tread type, are located below brackets 462 and secured thereto in any conventional manner. Guide bearings 466 (shown only in FIG. 15), also preferably of the roundway, tread type, are positioned outside end plates 460 and connected thereto in any conventional manner. Rotor pedestals 470 are supported by and extend upward from central portions of cross beams 456, and the rotor pedestals define top, arcuate surfaces 472 designed to fit against underside surfaces of impeller rotor 106.

Rotor Disassembly

To disassemble rotor 106, rotor stand 402 is placed forward of rotary machine 100, with top beams 420 of the rotor stand extending into fluid casing 112. Preferably, beams 420 are positioned parallel to the axis of impeller rotor 106. Shims (not shown) may be located below legs 422 and feet 424 of rotor stand 402 to adjust the height thereof until top surfaces of beams 420 are coplanar with the top surface of machine frame 104.

Beams 420, and thus rotor stand 402, are secured, preferably bolted, to machine frame 104.

Disc end fixture 406 and coupling end fixture 410 are secured to rotor stand 402 and machine frame 104 respectively. More specifically, as best understood from FIGS. 13 through 15, feet 446 of disc end fixture 406 are placed on lateral support brackets 434 of rotor stand 402. With disc end fixture 406 so mounted, cross members 452 thereof transversely extend over disc end 126 of impeller rotor 106 and disc end hydraulic cylinder 440 and yoke 442 are centered above the disc end of the impeller rotor. Feet 446, and thus disc end fixture 406, are then secured to brackets 434 by, for example, bolts. Similarly, as best understood from FIGS. 13, 14, and 16, coupling end fixture 410 is positioned with feet 446 thereof resting on transversely opposed sides of machine frame 104. Cross members 452 of coupling end fixture 410 transversely extend over coupling end 130 of impeller rotor 106, and coupling end hydraulic cylinder 440 and yoke 442 are centered above the coupling end of the impeller rotor. Feet 446 of coupling end fixture 410, and thus the coupling end fixture itself, are then secured to machine frame 104 in any suitable manner, for example by means of bolts.

Slings 444 are guided underneath disc and coupling ends 126 and 130 of impeller rotor 106, and ends of the slings are connected to opposite end portions of yokes 442. Circumferential grooves (not shown) may be machined in the surfaces of impeller rotor 106 to receive slings 444 to prevent the slings from axially sliding along the rotor surface. Hydraulic cylinders 440 are retracted, lifting yokes 442, slings 444, and thus rotor 106. Preferably, rotor 106 is lifted to a position slightly above the rotor position shown in FIG. 13.

Guide rails 404 are now mounted on and secured to machine frame 104 and rotor stand 402, with the guide rails extending past impeller blade 114, through fluid casing 112, and through casing opening 146, which was rendered open with the removal of bearing lifting frame 118 and casing section 142. Preferably, rails 404 are positioned on beams 420 of rotor stand 402 and longitudinally extend parallel to the axis of impeller rotor 106. Rails 404 may be secured to machine frame 104 and rotor stand 402 in any conventional manner, preferably via bolts. With rails 404 secured in place, disc end and coupling end cradles 412 and 414 are placed on the rails.

More particularly, bearings 464 of disc end cradle 412 are positioned on rails 404 forward of impeller rotor 114, with disc end cross beam 456 positioned between the rails and disc end guide bearings 466 located just inside the rails. Similarly, bearings 464 of coupling end cradle 414 are positioned on rails 404 rearward of impeller rotor 106, with coupling end cross beam 456 positioned between the rails and coupling end guide bearings 466 positioned immediately inside the rails. Thus, rails 404 support bearings 464 and cradles 412 and 414 for longitudinal movement therealong. However, movement of cradles 412 and 414 transverse to rails 404 is limited by abutting contact between the rails and guide bearings 466.

Figure 13:
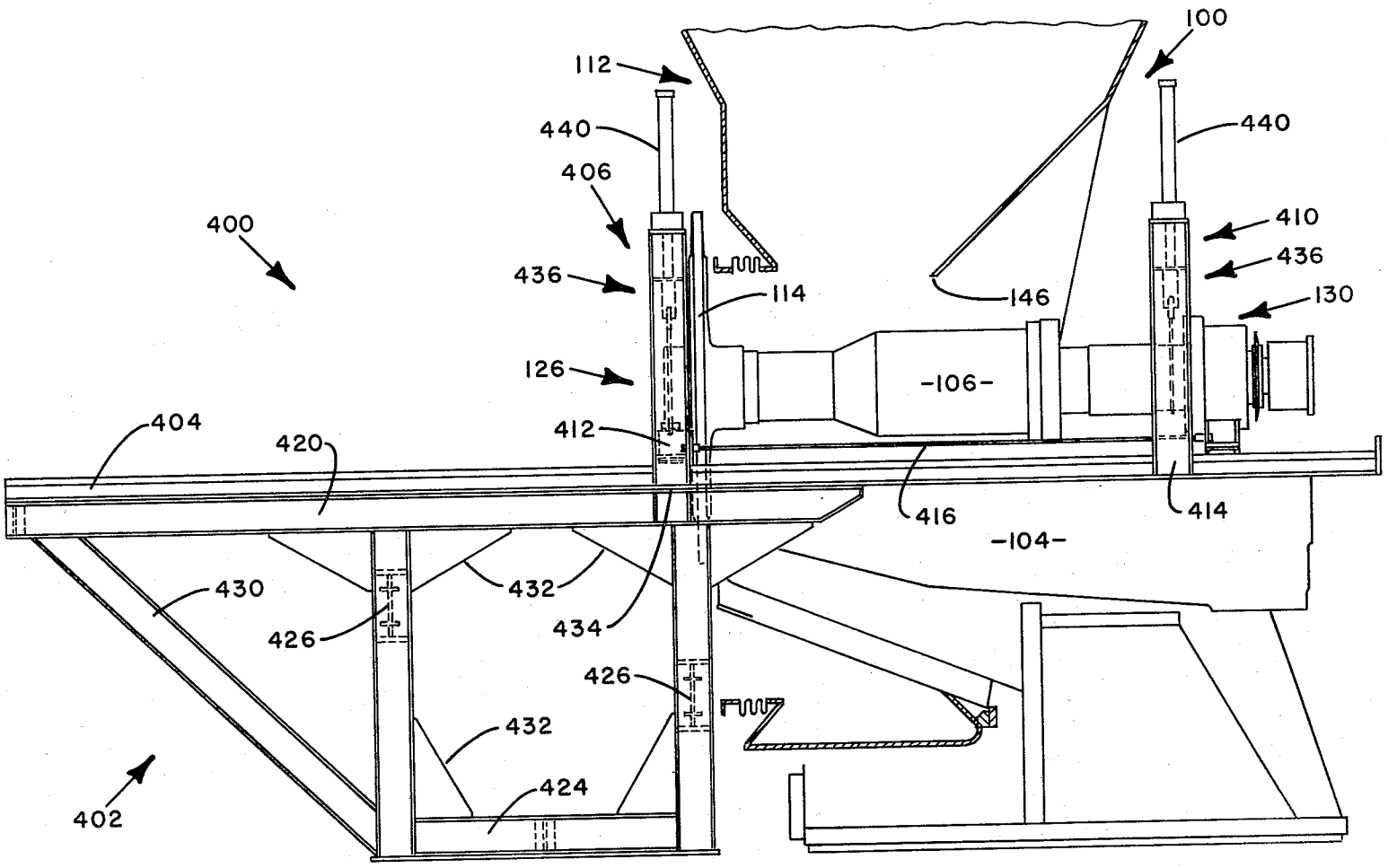
FIG. 13 is a side view of the partially disassembled rotary machine shown in FIG. 12 and of apparatus for assembling and disassembling the rotor of the machine.
Figure 14:
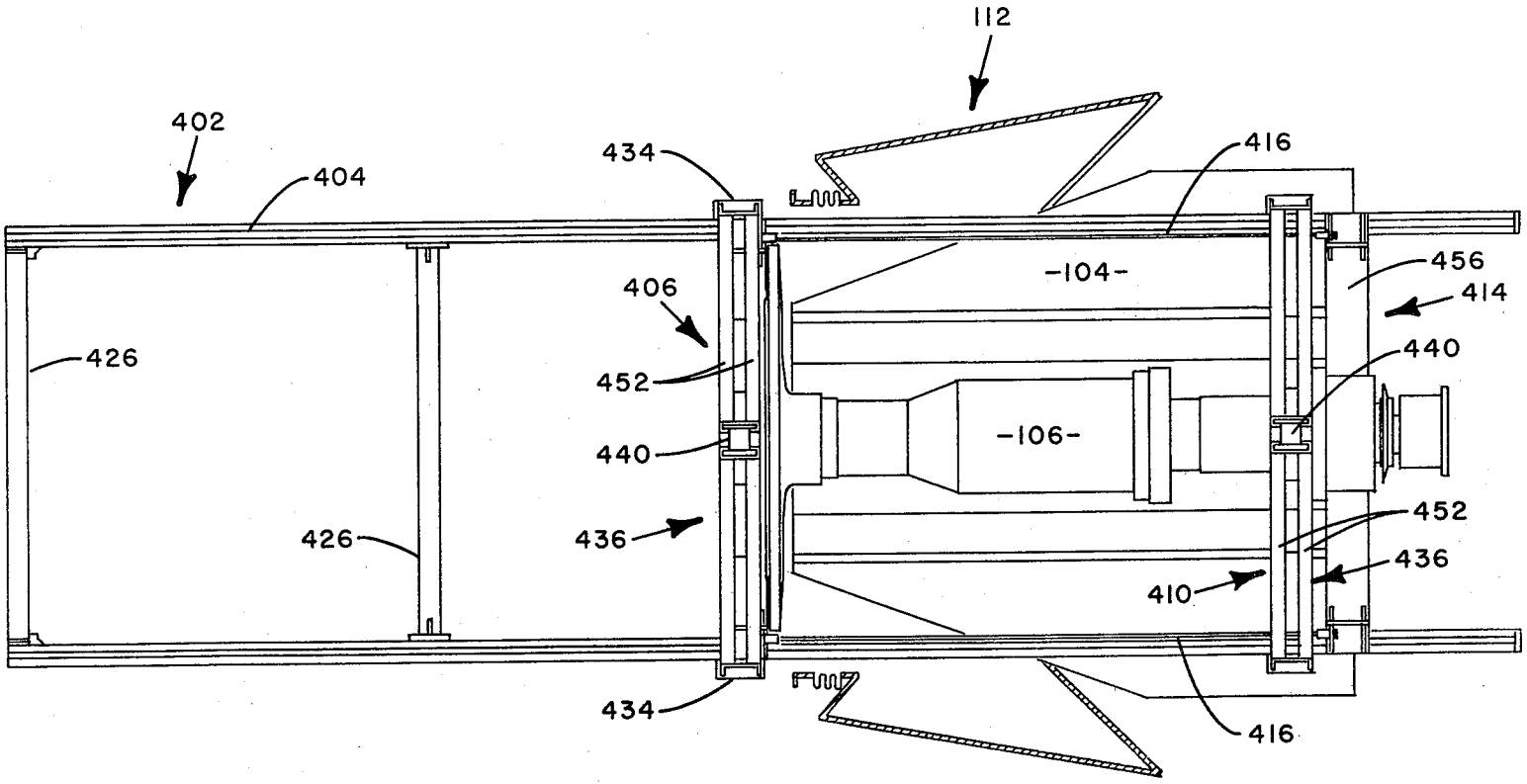
FIGS. 14, 15, and 16 are top, front, and rear views respectively of the machine and of the rotor assembly and disassembly apparatus shown in FIG. 13, with portions of the rotary machine fluid casing removed from FIG. 14 to more clearly show therein the rotor assembly and disassembly apparatus.

Disc end cradle 412 is rearwardly moved along rails 404 until abuttingly contacting impeller blade 114, with disc end pedestal 470 directly below disc end 126 of impeller rotor 106. Analogously, coupling end cradle 414 is forwardly moved along rails 404 until abuttingly contacting a rotor flange 124, with coupling end pedestal 470 directly below coupling end 130 of impeller rotor 106. Cables 416 are then employed to connect cradles 412 and 414, as shown in FIGS. 13, 14, and 17, wherein cables 416 transmit forward movement of the former cradle to the latter and transmit rearward movement of the latter cradle to the former. With cradles 412 and 414 in the position shown in FIG. 13, hydraulic cylinders 440 are extended, lowering rotor 106 onto the cradles, specifically rotor pedestals 466 thereof, as seen in FIGS. 13 through 16.

Slings 444 and disc end fixture 406 are removed. Rotor 106 is manually moved along rails 404, through casing opening 146 and fluid casing 112, and into the rotor disassembled position shown in FIG. 17 where the rotor is easily accessible to a worker or to other rotor handling equipment. Thus, rotor 106 is simply and conveniently moved into a disassembled position where the rotor and rotor blade 114 may be inspected or repaired, or wherefrom the rotor and blade may be moved to another location specifically equipped for rotor inspection and repair. Moreover, in the preferred embodiment, with rails 404 guiding movement of impeller rotor 106 as the rotor moves between the assembled and disassembled positions, axial orientation of the impeller rotor is maintained. That is, as rotor 106 moves between the assembled and disassembled positions, the axis of the impeller rotor is maintained substantially parallel to the axis of the rotor as assembled in machine 100.

Reassembly of the Rotary Machine

To reassemble machine 100, the above-described disassembly process is generally reversed. Rotor 106 is positioned, for example by an overhead crane, on cradles 412 and 414, as shown in FIG. 17, with impeller blade 114 just rearward of disc end cradle 412 and back rotor flange 124 immediately forward of coupling end cradle 414. Any equipment employed to move rotor 106 into the position shown in FIG. 17 is disconnected from the rotor and removed therefrom. Impeller rotor 106 is manually moved along rails 404, into fluid casing 112, and into the position shown in FIG. 13. Disc end fixture 406 is mounted on rotor stand 402, specifically brackets 434 thereof. Slings 444 are inserted underneath disc end 126 and coupling end 130 of rotor 106 and connected to yokes 442. Hydraulic cylinders 440 are retracted, lifting rotor 106 off cradles 412 and 414. Cradles 412 and 414 and cables 416 are removed. Hydraulic cylinders 440 are extended, lowering rotor 106 into the assembled position shown in FIG. 12. Slings 444, disc end fixture 406, and coupling end fixture 410 are removed.

Next, removable casing section 142, bearing lifting frame 118, and rotor seal 120 are replaced. Referring to FIGS. 10 and 11, pulling plates 316 are secured to machine frame 104, and pulling fixture 322 is placed on the machine frame with wedges 362 inserted between feet 334 and shoulders 354 of wheel bracket 352 so that apertures 350 of the pulling fixture are aligned with apertures 332 of the pulling plates. Removable casing section 142 is placed on pulling fixture 322. Specifically, T-brackets 320 of removable casing section 142 are positioned directly on the tops of legs 336 and 340 of pulling fixture 322. Pull rods 312 are inserted through aligned apertures 350 and 332. Nuts 364 and 366 are threaded over forward and rearward ends of pull rods 312. In contrast to the disassembly of casing section 142, however, when casing section 142 is reassembled, forward nuts 364 are brought into abutting contact with the rearward surface of leg flanges 346, and rear nuts 366 are brought into abutting contact with the forward surfaces of pulling plates 316. Rear nuts 366 are then rotated around pull rods 312 against pulling plates 316, forcing pull rods 312, pulling fixture 322, and casing section 142 axially forward. When removable casing section 142 reaches the desired axial location, pull rods 312 and nuts 364 and 366 are removed. Hydraulic jacks 302 are positioned underneath feet 334 and extended into contact therewith to support pulling fixture 322 independent of wheels 342. Wedges 362 are removed. Hydraulic jacks 302 are retracted, lowering removable casing section 142 into its assembled position and lowering legs 366 and 340 away from T-brackets 320. Hydraulic jacks 302 and pulling fixture 322 are removed, and casing section 142 is secured to machine frame 104.

Turning to FIGS. 8 and 9, bearing lifting frame 118 is placed, for example, by means of an overhead crane on the rearward portion of machine frame 104, with rollers 304 supporting the bearing lifting frame for rolling movement along the machine frame. Pull rods 310 are inserted through aligned apertures 324 and 330, and nuts 356 and 360 are threaded over forward and rearward ends of pull rods 310. It should be noted that, when frame 118 is reassembled, nuts 356 are positioned rearward of rib 314 and nuts 360 are located forward of pulling plates 316. Rear nuts 360 are then rotated about pull rods 310 against pulling plates 316 to force the pull rods and bearing lifting frame 118 axially forward into fluid casing 112. When bearing lifting frame 118 reaches the desired axial location, pull rods 310 and nuts 356 and 360 are removed. Hydraulic jacks 302 are located beneath shoulders 326 of rib 314 and extended into contact therewith to support bearing lifting frame 118 independent of rollers 304. Rollers 304 are removed, and cylinders 302 are retracted, lowering lifting frame 118 into its assembled position. Hydraulic jacks 302 are removed, and bearing lifting frame 118 is secured to machine frame 104.

Rotor seal 120 is then reassembled. Rotor seal 120 may be manually positioned within fluid casing 112 or transfer car 220 may be used, in a manner similar to that described in detail below with the reference to the reassembly of disc end bearing 132, to carry the rotor seal into the fluid casing. Once within fluid casing 112, rotor seal 120 is manually inserted into its assembled position. Guide rods may be extended through aligned, axial apertures of rotor seal 120 and radial flange 150 of bearing lifting frame 118 to guide axial movement of the rotor seal into its assembled position. When in its assembled position, rotor seal 120 is secured, preferably bolted, to bearing lifting frame 118, specifically radial flange 150 thereof.

Referring now to FIGS. 3 through 6, the next step in reassembling machine 100 involves replacement of bearing elements 132, 134, and 136. Guide rails 216 are mounted on and secured to machine frame 104. Transfer car 220, with bearing support rollers 260 in the raised position, is mounted on rails 216, and disc end bearing 132 is placed on bearing support rollers 260. Transfer car 220 and disc end bearing 132 are moved along rails 216 to a position axially forward of rotor flange 122. Turnbuckle 236 is retracted, lowering bearing support rollers 260 and disc end bearing 132. Transfer car 220 and disc end bearing 132 are further moved into fluid casing 112 until the disc end bearing reaches a location directly above its assembled position. Hook ends of cables 210 are connected to disc end bearing 132, and winch 214 is employed to lift the disc end bearing off transfer car 220. Transfer car 220 is removed, and disc end bearing 132 is lowered into its assembled position. Hooks 212 are disconnected from disc end bearing 132, and the disc end bearing is secured to machine frame 104.

Now, intermediate bearing housing 134 is placed on housing support platform 226 of transfer car 220, and the transfer car, with bearing support rollers 260 in the raised position, is moved forward along guide rails 216. Transfer car 220 and intermediate bearing housing 134 are moved into fluid casing 112 until the intermediate bearing housing reaches a location directly above its assembled position. Cables 210 are removed from front pulleys 202 so that the cables extend downward from middle pulleys 204. Hooks 212 are connected to intermediate bearing housing 134, and winch 214 is employed to raise the intermediate bearing housing off platform 226 of transfer car 220. Transfer car 220 is removed, and intermediate bearing housing 134 is lowered into its assembled position. Hooks 212 are disconnected from intermediate bearing housing 134, and the intermediate bearing housing is secured to machine frame 104. Hooks 212, cables 210, winch 214, and guide rails 216 are all removed from machine 100. Next, coupling end bearing 136 is replaced in a conventional manner, for example by means of a crane, and secured to machine frame 104.

Finally, with reference to FIG. 1, inlet duct 152 and any support stand therefor are repositioned forward of fluid casing 112, and the inlet duct is resecured to the forward end of fluid casing 112. Machine 100 is now reassembled and ready for operation.

With the above-discussed assembly and disassembly methods and apparatus, machine 100 is disassembled and reassembled comparatively quickly and simply. The use of guiding elements such as rails 404 and 216 to maintain axial orientation of various parts of machine 100 as these parts move between assembled and disassembled positions substantially facilitates realigning these many parts, significantly reducing the amount of human labor needed to realign the parts. Moreover, the above-discussed assembly and disassembly processes do not require moving or disassembling any part of machine frame 104, further simplifying and expediting disassembly and reassembly of machine 100 and, obviously, eliminating any requirement to reposition and realign parts of the machine frame.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

1. Assembly and disassembly apparatus for use with a rotary machine having a machine frame, an impeller rotor axially extending along the machine frame, and a fluid casing annularly extending around the rotor and the machine frame which defines a casing opening annularly extending across the machine frame and above the impeller rotor, the assembly and disassembly apparatus comprising:

a rotor stand having a base adapted to be positioned adjacent to the rotary machine for supporting the impeller rotor in a disassembled position;

a pair of spaced parallel rails supported by the rotor stand and extending longitudinally along the base of the stand and cantilevered away from the base thereof, said cantilevered rails being adapted to extend through the fluid casing opening and into the fluid casing in substantially parallel relation to the rotor axis, and to be secured to the machine frame for guiding movement of the impeller rotor between the machine frame and the rotor stand;

a disc end cradle for supporting the disc end of the impeller rotor, the disc end cradle being movably mounted on said rails for movement in an axial direction therealong;

a coupling end cradle spaced from the disc end cradle, for supporting the coupling end of the impeller rotor, the coupling end cradle being movably mounted on said rails for movement in an axial direction therealong independently of the disc end cradle;

a disc end fixture including means for raising and lowering the disc end of the impeller rotor into and out of the rotor assembled position and onto and off of the disc end cradle;

a coupling end fixture including means for raising and lowering the coupling end of the impeller rotor into and out of the rotor assembled position and onto and off of the coupling end cradle; and bearing means disposed between the disc and coupling end cradles and said rails for facilitating axial movement of said disc and rotor cradle means along the rails with the impeller rotor positioned thereon to move the rotor outwardly from the fluid casing of said machine onto the rotor stand.

2. Assembly and disassembly apparatus for use with a rotary machine having a machine frame, an impeller rotor axially extending along the machine frame and a fluid casing annularly extending around the rotor and the machine frame and defining a casing opening annularly extending across the machine frame and above the impeller rotor the assembly and disassembly apparatus comprising:

a rotor stand having a base adapted to be positioned adjacent to the rotary machine for supporting the impeller rotor in a disassembled position;

a pair of parallel, spaced rails supported by the rotor stand and longitudinally extending along the base of the stand and cantilevered away from the base thereof and with the cantilevered rails being adapted to extend through the fluid casing and into the fluid opening in substantially parallel relation to the rotor axis and being adapted to be secured to the machine frame for guiding movement of the impeller rotor through the casing opening and the fluid casing between the machine frame and the rotor stand a disc end cradle movably mounted on the rails and adapted to support the disc end of the impeller rotor for movement therealong, said disc end cradle including, a disc end beam located between the rails, means extending between the rails and the disc end beam for supporting the disc end beam, a disc end pedestal extending upwards from the disc end beam removably secured thereto for receiving the disc end of the rotor;

a disc end fixture supported by the rotor stand for moving the disc end of the impeller rotor between a rotor assembled position and the disc end cradle, the disc end fixture including, a disc end frame supported by and extending between transversely opposed sides of the rotor stand and having a cross member adapted to overlie the impeller rotor, disc end carrying means adapted to extend around the disc end of the impeller rotor, and disc end power means connected to the cross member of the disc end frame and the disc end carrying means for raising and lowering the disc end of the impeller rotor from and onto the disc end cradle; and a coupling end cradle spaced from the disc end cradle, for supporting the coupling end of the impeller rotor, the coupling end cradle being movably mounted on said rails for movement in an axial direction therealong independently of the disc end cradle; and a coupling end fixture including means for raising and lowering the coupling end of the impeller rotor into and out of the rotor assembled position and onto and off of the coupling end cradle.

3. Assembly and disassembly apparatus as defined by claim 1 wherein the disc end fixture further includes rotor lifting means mounted on said rotor stand for moving the disc end of the impeller rotor between the rotor assembled position and the disc end cradle, said disc end fixture including a disc end frame supported by and extending between transversely opposed sides of the rotor stand and having a cross member adapted to overlie the impeller rotor, disc end carrying means adapted to be connected to the disc end of the impeller rotor for vertically supporting the rotor, disc end power means secured to the disc end frame and disc end carrying means for raising and lowering the disc end carrying means and the disc end of the impeller rotor relative to the disc and coupling end cradles.

4. Assembly and disassembly apparatus as defined by claim 3 including removable coupling means interconnecting the disc end cradle and the coupling end cradle for transmitting force therebetween.

5. Assembly and disassembly apparatus as defined by claim 3 wherein the disc end fixture includes:

a pair of legs extending upwardly from the rotor stand; and the cross member is secured to and extends between upper portions of the legs;

the lifting means includes a hydraulic cylinder supported by the cross member;

said disk end carrying means comprises a yolk secured to the hydraulic cylinder, and a sling secured to the yolk adapted to extend around the ends of the impeller rotor to support the rotor during lifting and lowering thereof.

6. Assembly and disassembly apparatus as defined by claim 3 wherein:

the disc end cradle includes:

a disc end beam located between the rails, support bearings positioned on the rails and connected to the disc end beam to support the disc end beam for longitudinal movement along the rails, disc end guide bearings connected to the disc end beam and located adjacent the rails, wherein abutting contact between the disc end guide bearings and the rails limits transverse movement of the disc end cradle relative thereto, and a disc end pedestal secured to and extending upward from central portions of the disc end beam for receiving the disc end of the impeller rotor; and the coupling end cradle includes:

a coupling end beam located between the rails, support bearing positioned on the rails and connected to the coupling end beam to support the coupling end beam for longitudinal movement along the rails, coupling end guide bearings connected to the coupling end beam and located adjacent to the rails, wherein abutting contact between the coupling end guide bearings and the rails limits transverse movement of the coupling end cradle relative thereto, and a coupling end pedestal secured to and extending upward from central portions of the coupling end beam for receiving the coupling end of the impeller rotor.

* * * * *